United States Patent [19]

Grogg, Sr.

[11] 4,213,269

[45] Jul. 22, 1980

[54] AMUSEMENT VEHICLE

[76] Inventor: Charles J. Grogg, Sr., 2964 Sunflower St., Thousand Oaks, Calif. 91360

[21] Appl. No.: 883,210

[22] Filed: Mar. 3, 1978

[51] Int. Cl.[2] ..... A63H 17/04

[52] U.S. Cl. ..... 46/219; 124/82

[58] Field of Search ..... 46/202, 219, 1 E; 124/49, 50, 82

[56] References Cited

U.S. PATENT DOCUMENTS

| | | | |
|---|---|---|---|
| 2,652,822 | 9/1953 | Griffith | 124/49 |
| 2,921,573 | 1/1960 | Horowitz et al. | 124/82 X |
| 3,065,569 | 11/1962 | Nielson et al. | 46/219 |
| 3,869,825 | 3/1975 | Heberlein | 46/219 |

*Primary Examiner*—Louis G. Mancene
*Assistant Examiner*—Mickey Yu

[57] ABSTRACT

A toy tank is disclosed having tracks and a cannon supported on a turret. The tracks consist of multi-element, hingeable links forming a chain type loop supported by tensioned rollers and idlers such that the tracks are articulated realistically in accordance with the contours of the surface on which the tank travels. The turret carries a cannon for dispensing bullet-like projectiles in a realistic fashion. Atop the turret is a projectile containing and feeding mechanism which automatically loads the breech of the cannon when the cannon ram rod or plunger is fully withdrawn therefrom in order that same is cocked for the next firing sequence.

10 Claims, 9 Drawing Figures

FIG. 5
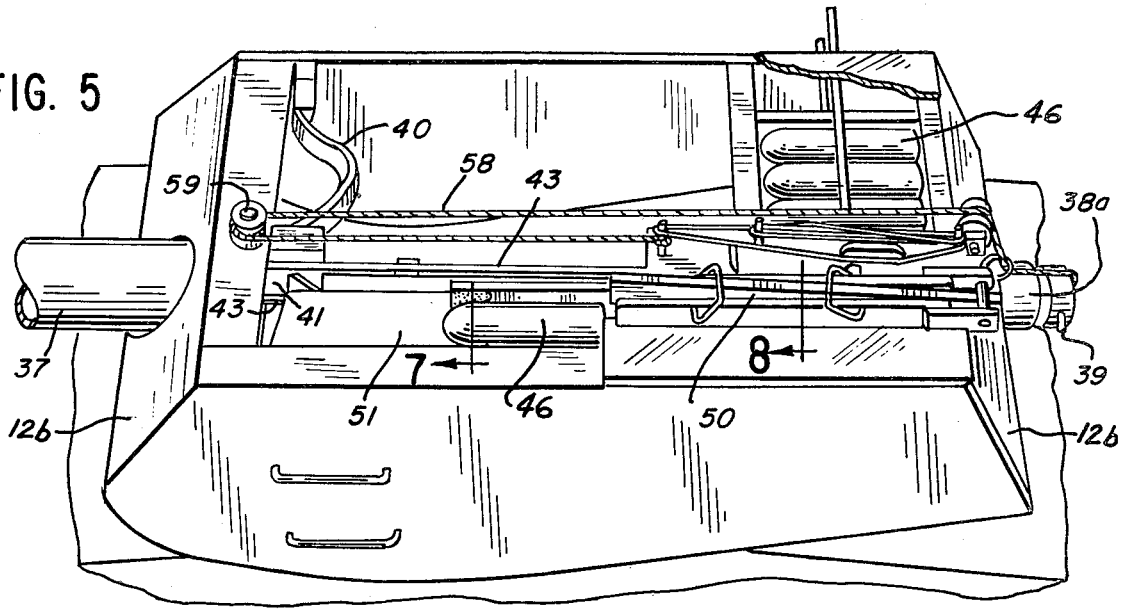
FIG. 6
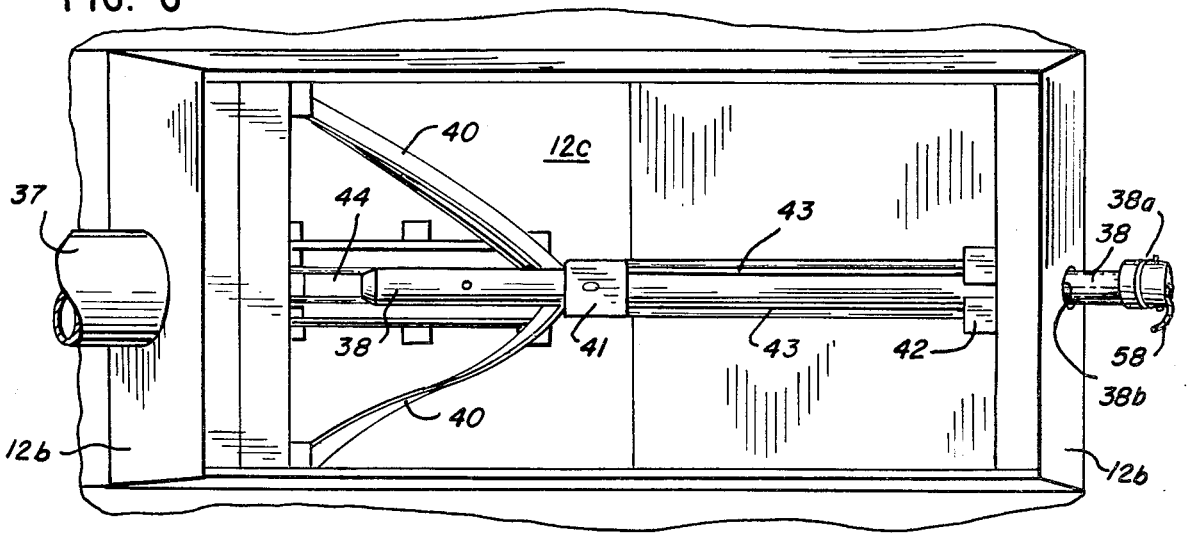
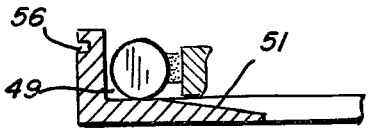
FIG. 7
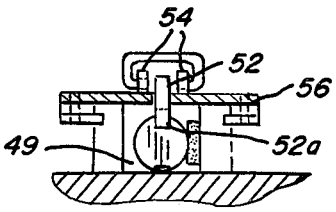
FIG. 8

AMUSEMENT VEHICLE

BACKGROUND OF THE INVENTION

This invention relates to toy tanks having turrets and cannons and more particularly such tanks which include articulated track members for movably supporting same in a realistic fashion. Known toys with tracks such as toy tanks, tractors or the like having track type support members generally include reversed rubber cog belts which convey the idea but are not accurate representations of actual track mechanisms either in terms of function or performance in operation. Similarly, such track type tanks rarely include a pivotable turret with an automatic feeding and dispensing system for projectiles.

It is therefore an object of the invention to provide a toy tank with a pivotable turret which includes an articulated multi-element track system that is able to follow the contours of the surface terrain.

Moreover it is a further object of the invention to provide a toy tank with a turret that includes an automatic projectile containing and feeding system which operates to load the breech of the cannon when same is cocked.

A still further object of the invention is to provide a realistic toy cannon which functions in a realistic manner thereby stimulating the user's imagination.

SUMMARY OF THE INVENTION

The aforesaid realism is achieved by a toy tank which includes an articulated multi-element track system and a projectile containing, feeding and dispensing system. The tank has a chassis with a generally hollow body portion supporting for pivotal movement an upper turret portion. The body portion has a top flat turret platform and depending spaced parallel walls which carry the suspension means for the track system. Through the mid-portions of the walls are a series of pivotable pins which support for parallel swinging movement against the outside of the walls trailing arms on the lower ends of each are axles for rotatable rollers. Mounted above the pivot pins along the upper portions of the walls are idlers carried for rotatable movement about their axes. Two tracks carry the toy tank by forming elongated chain loops about the idlers and rollers. To tension the tracks the roller pivot pins are biased by inner arms which extend parallel to the inside of the walls; these arms are pivotable about the axis of their pins and are urged by resilient members to cause the rollers to engage their respective tracks. The rearmost idlers on each wall are adapted to remove any slack in the track chain loops caused by variations in the contours against which they run by biasing the upper portions of each track.

The turret carries a cannon and an automatic containing and feeding system for the projectiles to be dispensed through the cannon. The cannon bore mates with a plunger having a companion crossection. The plunger is fully cocked slightly beyond the breech of the bore and it is the movement of the plunger that is used to move the projectiles through the feeding and containing system to the breech of the cannon. Specifically, as the plunger is pulled to its cocked position, a cable connected between the plunger and a shuttling pawl draws the pawl and projectiles carried thereby toward the breech. Whereby the projectiles are moved from the containing portion of the system along a feeding channel to a ramp from where they roll into the breech. Release of the plunger will eject the breech loaded projectile through the cannon bore.

BRIEF DESCRIPTION OF THE DRAWINGS

FIG. 5 shows a partial perspective view of the feeding and containing system, FIG. 6 shows a top view of the feeding and containing system, FIG. 7 is a partial section along 7—7 of FIG. 5, FIG. 8 is a partial section along 8—8 of FIG. 5.

DETAILED DESCRIPTION OF THE INVENTION

Figure 1:
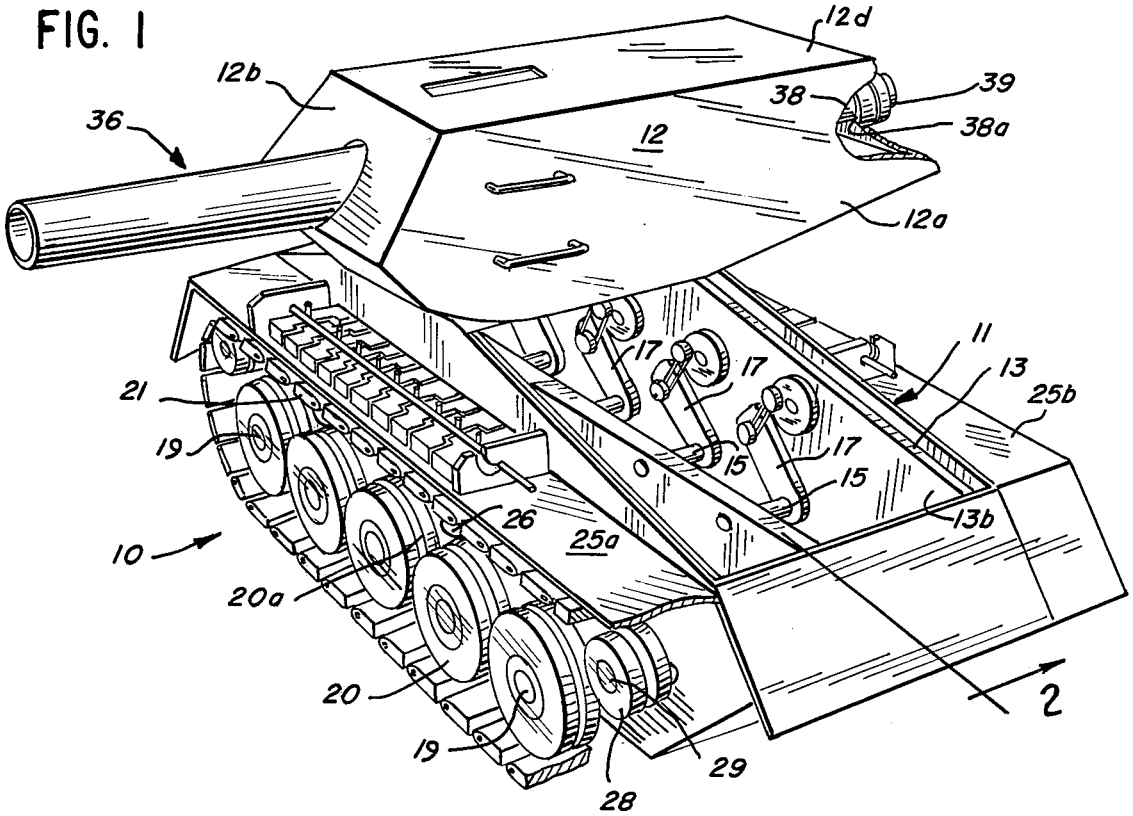
FIG. 1 shows a perspective view of the rear side of the tank and turret with parts of the track suspension system shown in cut away.

FIG. 1 shows a tank 10 which includes a hollow body 11 atop which is carried a pivotal turret 12. The tank 10 includes chassis 13 which has a pair of upright walls **13*a* and 13*b*. Upon walls 13*a* and 13*b* is carried a suspension system 14 and more particularly extending through the upper portions of walls 13*a* and 13*b* are a series of pins 15 of cylindrical configuration which are normal to walls 13*a* and 13*b*. Connected to the outer end of each pin 15 is an outer arm 16 and connected to the inner end of each pin 15 is an inner arm 17. Outer arms 16 extend in trailing relation relative to the direction of travel of the tank 10 and carry at their extreme lower end, opposite the end at which pin 15 is connected, a roller axle 19 about which rides a disc shaped roller 20 in substantially parallel relation to the walls either 13*a* or 13*b*. Inner arms 17 extend parallel to and juxtaposed with the insides of walls 13*a* or 13*b* and act as a moment arm to be resiliently biased thereby placing each pin 15 in torsion to bias outer arms 16 downwardly relative to the body 11. As will be explained later the biasing is caused by resilient members 18 hooked between arms 17 and walls 13*a* or 13*b*. Consequently, rollers 20 carried on roller axle bearings 19 are biased downward to act as the prime elements of the suspension system 14 in carrying resiliently the weight of the tank 10. Each roller 20 has a circumferential groove 20*a* which guides a track system 21**.

Figure 2:
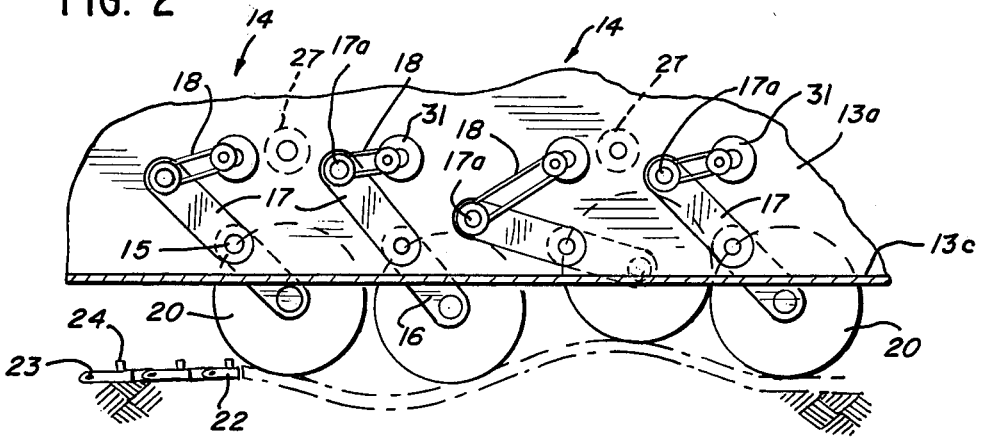
FIG. 2 shows a partial and enlarged inside sectional view along lines 2—2 of FIG. 1.

Each track system 21 is composed of a series of hingeably connected elongated track links 22, see FIGS. 1 or 2. The track links 22 are of interlocking configuration in that one side of each has a "C" shape which encloses an extending tab of an adjacent link within the mouth of the "C". Thus the adjacent links 22 interlock and cooperate by means of transversely disposed link hinge pins 23. A series of links 22 are hinge connected end to end to form a closed loop chain which forms a track for one side of the tank 10. Each link 22 is elongated such that its width to length ratio is approximately 2½ to 1; the width being the distance between the adjacent parallel hinge pins 23. The closed loop track system 21 forms a flexible chain like member of adequate surface to support the tank 10.

Extending inwardly from each track link 22 is a normally disposed cylindrical locating pin 24 for locating each track link 22 transversely relative to rollers 20. That is to say that, each track locating pin 24 is positioned to align in the circumferential groove 20*a* as it passes a roller 20. The track locating pins 24 are seen in FIG. 1 wherein an extra supply of hingeably connected track links 22 are stored on a track fender 25*a* horizontally extending above the track system 21 and normal to wall 13*a*, or similarly, on a fender 25*b* which extends normally from the upper side of wall 13*b*.

In order to maintain a taut condition in the track systems 21 against the tensioned rollers 20, there are four spool shaped idlers 27 carried by the upper portion of each wall 13*a* and 13*b* in parallel relation. The front three idlers 27 are carried on outwardly extending axles 27*a* that are cantilever and normal to either the upper exterior side of wall 13*a* or 13*b*. The idlers 27 rotate freely about their respective axles 27*a*. Each idler 27 carries a circumferential groove 27*b* which cooperates with the track locating pins 24 in the manner described in connection with rollers 20 and each idler 27 is positioned in spaced relation relative to its adjacent idler so as to support the upper inside of its respective track system 21 from sagging and interferring with any roller arm 16 or any roller 20.

At the rear upper inside corner of each track system 21 another spool like idler 28 is carried for horizontal longitudinal movement relative to tank 10. Each rear idler 28 is supported for free rotary movement on a slidable rear axel pin 29 which rests in a longitudinal grooves disposed in the rear upper portions of either wall 13*a* or 13*b*. Axle pin 29 is tensioned rearwardly by resilient member 30 to keep constant pressure on the inside surface of track system 21 thereby relieving any tendency to sag or have slack in said system.

Figure 3:
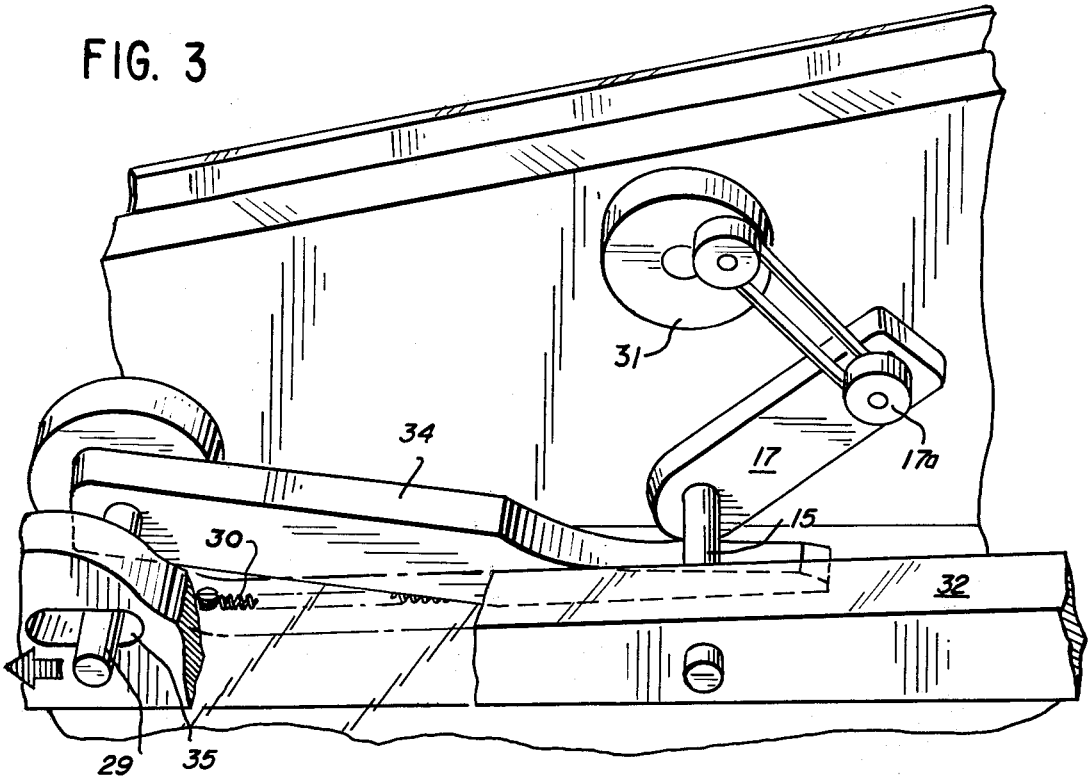
FIG. 3 shows an enlarged fragmentary perspective of the inside of the rear track tensioning and suspension system.
Figure 4:
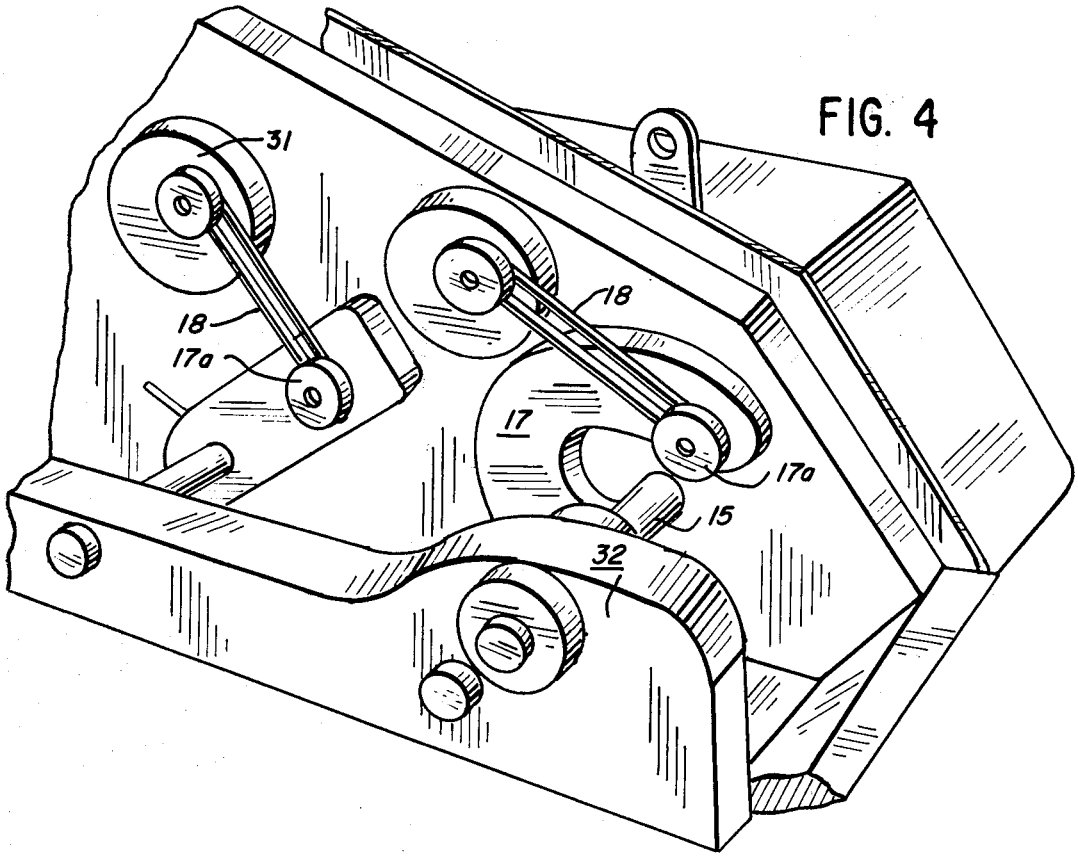
FIG. 4 shows an enlarged partial perspective of the front track suspension tensioning system.

The techniques for biasing the rollers 20 and the rear idler 28 are best disclosed in FIGS. 2, 3, and 4. For simplicity and low cost the resilient members 18 used for the rollers 20 are in the nature of flexible resilient loops such as rubber bands. It will be appreciated that any form of spring member can be used or adapted for use to bias the various components of the tank 10. In the preferred embodiment as shown in FIG. 2, the inner arms 17 are equipped with a knob 17*a* located at the end opposite the connection between arm 17 and pin 15. Carried on the inner surfaces of either wall 13*a* or 13*b* are a series of adjustable supports 31 for resilient members 18. Each support 31 is arranged for restrained pivotable movement on either wall 13*a* or 13*b*. That is to say that, the supports form an adjustable positionable locating means for one end of each resilient member 18. The other end of the member 18 is hooked about the knob 17*a* whereby tension adjustment of resilient member 18 can be easily made by rotating the respective support 31, see FIG. 2. The operation of the tensioned rollers 20 are shown in FIG. 2 wherein the various resilient members 18 are extended in accordance with the load placed upon each roller 20 which is caused by the articulated conformation of the track system 21 with the terrain. Shown in FIG. 4 is a slightly modified roller tensioning system for the front roller 20; it is necessary because of the limited space. More particularly, the inner arm 17 is "C" shaped such that the mouth of the "C" or curve clears the pin 15 of the front roller 20. The pin 15 extends through and into the chassis 13 to the area between walls 13*a* and 13*b*. A floor 13*c* located between the bottoms of walls 13*a* and 13*b* supports a pair of longitudinal inside support walls 32 and 33 for walls 13*b* and 13*a* respectively, see FIGS. 1, 3 and 4. The purpose of walls 32 and 33 is primarily to locate the insidemost ends of pins 15 in order to overcome any cantilever loads which might be imposed upon them. Wall 32 is shown; a similar wall 33 which cooperates with the pins 15 that extend through the wall 13*a* is not shown, but is identical.

The tensioning means for one rear idler 28 is shown in FIG. 3 there is a similar system for both rear idlers 28. More particularly, between inner wall 32 and the inside of wall 13*b* there is a slidable link or track tensioner 34 which at its rearmost end supports in bearing type fashion a sliding axle pin 29 for the rear idler 28. A horizontal longitudinal slot 35 for the inner end of the sliding pin 29 is provided in the inner wall 32. Slot 35 is similar in configuration to an equivalent slot in wall 13*b* (not shown) thus the sliding pin 29 is permitted to move and carry the track tensioner fore and aft with it when necessary. The track tensioner 34 is resiliently biased rearwardly in order to maintain constant tension in the track system 21 by a coil tension spring 30. Spring 30 connects between bottom of the track tensioner 34 and the rear floor 13*c* of the chassis 13. The track tensioner 34 is an elongated plate like link with a front tongue portion which is positioned for sliding beneath the pin 15 for the first roller 20 immediately in front of the rear idler. The tongue of the track tensioner 34 is provided to guide the tensioner in its movement fore and aft without allowing rotation. The rear idler 28 is constantly biased rearward and acts to remove the slack in the track system 21; while not shown the tensioning system for the track which rides against wall 13*a* is identical.

In FIG. 1 the turret 12 is shown pivoted relative to the body 11. The turret 12 is basically a hollow structure consisting of a pair of sides 12*a*, a front and a rear 12*b* and a floor 12*c*. Through the front wall 12*a* of the turret 12 is an aiming system 36 which consists of a gun barrel or cannon 37 and a plunger 38 of crossection compatable to the cannon bore rides therein and extends rearwardly through the turret 12 and out the rear 12*b*. The plunger 38 includes a plunger stop 38*a* which stops the plunger 38 in its forwardly most position against the rear wall 12*b*. The stop 38*a* consists of transverse peg 39 and a pair of washers which are resilient such that the stopping of plunger 38 is cushioned as it moves to its forwardmost position. Plunger 38 is connected between the inside of the turret 12 near the front 12*b* and the medial portion of the plunger by means of a resilient member 40 or rubber band. The interconnection of plunger 38 and member 40 is adjustable so that the plunger force is adjustable. That is to say that, an adjustable retainer 41, being an elongated pin, cooperates with holes 38*b* positioned vertically along and through the mid portion of the plunger 38. Whereby the location of retainer 41 can be shifted from one hole 38*b* to the next to adjust the tension as desired for varing the force for the plunger 38 in cannon 37, see FIG. 6.

A pair of "U" shaped supports 42 rest upon the floor 12*c* of the turret 12 and carry horizontally disposed plunger support rods 43 which longitudinally extend within the turret 12 from the inside of the turret front 12*b* to the inside of the turret back 12*b*. The rods 43 and "U" shaped supports 42 act to guide the plunger when it is withdrawn from the bore of the cannon 37 and is at its rearwardmost position. The plunger 38 forms an opening inbetween it and the rear of the cannon 37 that opening is called the breech 44. The breech 44 is located beneath a slot 45 that extends longitudinally and through the closure or top 12*d* of the turret 12. Projectiles 46 which are brought into alignment with slot 45 are fed directly into the breech 44 if the plunger 38 is in its rearwardmost position and the breech 44 is open.

There is also a projectile feeding and containing system 47 adapted to be carried atop the turret closure 12*d* and in alignment with slot 45. The feeding and containing system 47 is best shown in FIG. 1; system 47 includes a magazine or shell container portion 48 and a shell transport slot or channel 49. The channel 49 and the magazine 48 are in the same plane but are arranged normal to one another such that the frontmost shell in the magazine is aligned longitudinally with the rear end of channel 49. A shuttle mechanism 50 is provided to move the projectiles 46 from the magazine through the channel 49 to a ramp 51. Ramp 51 is inclined downwardly to deliver projectiles 46 into slot 45 and thus to breech 44 of the cannon 37. The ramp 51 is inclined toward the slot 45 such that when the projectile 46 is feed by the shuttle mechanism 50 through the channel 49 and it reaches the front thereof; it hits ramp 51 and rolls down into the slot 45.

Figure 9:
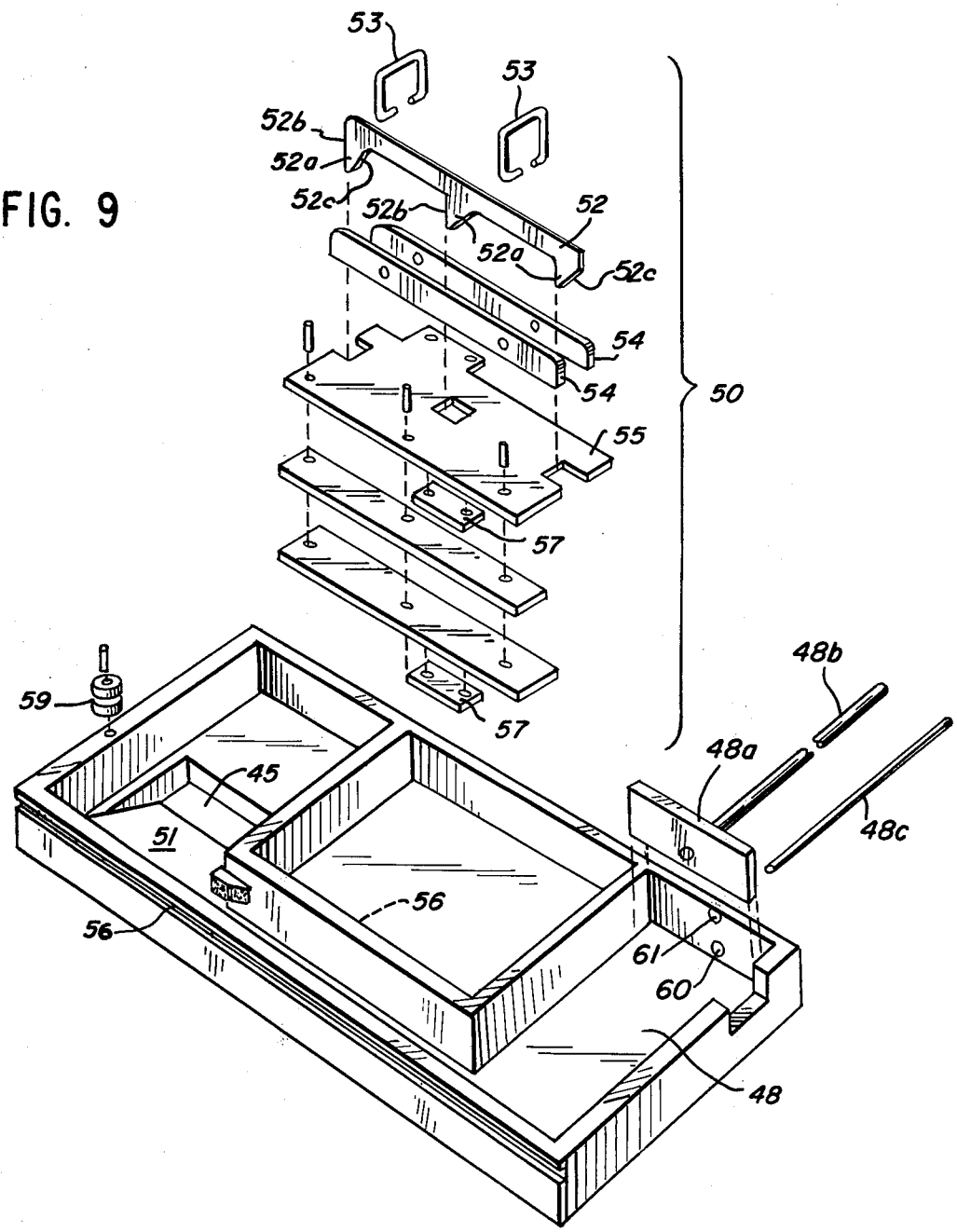
FIG. 9 is an exploded view of the feeding and containing system.

The shuttle mechanism 50 includes a sliding pawl 52 which is adapted to ride within the center of channel 49. The pawl 52 is arranged to move freely up and down relative to the channel 49. Pawl 52 includes a pair of vertically spaced openings for controlling and containing projectiles 46 during movement (in a forward direction only) through the channel 49, see FIGS. 7, 8 and 9. The foregoing is accomplished by means of angled teeth 52*a* that extend downwardly into the channel 49 and carry projectiles 46. The front surface 52*b* of each tooth 52 is vertical and acts to push a projectile 46 while the rear surface 52*c* of each tooth 52 is inclined and acts to cam pawl 52 upwardly over the projectiles 46 when the pawl 52 is moved in a rearwardly direction. Pawl 52 can only move projectiles 46 in a forward direction. Pawl 52 is carried in an upright vertical position by a pair of wire bails 53 which are mounted on a pair of vertically disposed pawl guides 54. Guides 54 are attached to a horizontal pawl plate 55 in a parallel spaced front to back relation for guiding the pawl 52 within the channel 49 and for permitting free up and down and controlled fore and aft movement of the pawl 52. Bails 53 are pivotally carried on guides 54 to extend between them and over pawl 52. Longitudinal grooves 56 are provided on the outsides of the walls of channel 49 for guiding the pawl plate 55. More particularly, there are cooperating groove lugs 57 which engage the grooves 56 to assure that the pawl plate 55 rides in alignment with the channel 49. Bails 53 connect to guides 54 by inwardly extending parts 53*a* which fit within holes in the pawl guides 54 such that the bails 53 are free to rotate about their ends 53*a*. In their most vertical position they permit the pawl 52 to move upwardly enough to clear the diameter of projectile 46 whereby the pawl can skip rearwardly across the projectiles 46 and can be aligned for dropping down and catching additional projectiles for movement of same forwardly in the channel 49. Thus, in a shuttle fashion, the pawl 52 moves rearwardly to catch two projectiles (one already in the channel 49 and one at the forwardmost position in the magazine 48) before moving same through the channel 49 to the ramp 51 for loading into the breech 44. The projectiles 46 are contained in side to side relation in the magazine and are biased toward channel 49. There is shown a pusher 48*a* and its associated drive handle 48*b* which extend through the side wall of the magazine 48 at the lower hole 60 therein shown. A retaining rod 48*c* shown in FIG. 9 extends through upper hole 61 across the top of magazine 48 above the projectiles 46 to retain them, see FIGS. 5 and 9.

The movement of the shuttle is controlled by a cable 58 which is connected between the plunger and the shuttle plate 55 whereby the cable 58 is caused to pull the shuttle forward as the plunger 38 is drawn rearward for cocking. Thus, as the plunger 38 is cocked the shuttle moves forwardly to carry projectiles 46, loaded in the magazine 48, through the channel 49 to the ramp 51. The cable 48 is aligned between the plunger 38 and the plate 55 by means of a cable pulley 59 mounted to the front of the feeding and containing system 47, see FIG. 1. Pulley 59 is carried for rotary movement about a vertical axis whereby the cable 58 extends forwardly from the plunger 38 around pulley 59 and then rearwardly to the leading edge of the pawl plate 55 thus rearward motion of the plunger 38 is translated into forward and equivalent motion of the shuttle mechanism 50.

While what has been shown and described is the preferred embodiment of the tank 10 those skilled in the art will no doubt appreciate that variations and modifications to the basic concept can be made without deviating from the invention in its broader aspects. That is to say that, the resilient members could be springs and the components could be manufactured of various shapes or materials which would perform the intended functions in similar or identical fashion but which would appear different in design. What is intended to be protected is included in the claims which follow.

What is claimed is:

1. An amusement vehicle having articulated multi-element tracks and a projectile feeding and dispensing system comprising; a chassis composed of a platform means including a pair of spaced parallel walls, a plurality of suspension arms each carried in trailing relation by a torsionally biased rotatable pin which extends normally through the middle portion of said walls, roller members each supported for free rotary movement in parallel relation to said walls at the arm end opposite said pin end for permitting controlled arcuate swinging motion of said roller members about said pin axis, idler means supported in parallel relation to said walls near the topmost section thereof for rotary movement, track means composed of articulated links hingeably interconnected along an elongated part of each for forming a chain loop to run about said roller members and said idler means as a pair of tracks each extending normally to one of said walls and said biased suspension arms acting to tension said tracks, resilient means connected between the said pins and said walls for urging each said arms carried thereon to bias said roller members carried thereby into engagement with the inner circumference of said track, a hollow enclosure supported for pivotal movement relative to said platform means for containing a projectile dispenser including an aiming device of tubular configuration having a companion plunger for permitting sliding mating inter engagement therebetween, force means connected between said plunger and said enclosure for selectively driving said plunger in said aiming device to propel projectiles therein through said device at increasing velocity, a supply means carried atop said hollow enclosure for containing and feeding projectiles to said plunger aiming device when said plunger for same is drawn to a cocked position, interconnecting means between said plunger and a projectile transportation means carried for shuttled movements upon said supply means to push each projectile from the containing portion of said supply means along a feeding channel for receipt therefrom in the breech of said aiming device as said plunger is drawn to its fully cocked position.

2. The amusement vehicle of claim 1 wherein each said roller member includes a circumferential groove, each said articulated elongated hinged link include an inwardly extending pin normal to the center surface thereof such that said extending pin is arranged to cooperate with said groove as said track is moved or translates relative to and tangentially with respect to the circumference of said roller members during the forward or rearward movement of the vehicle.

3. The amusement vehicle of claim 2 wherein said idler means include at least one idler mounted upon an axis for fore and aft movement in a horizontal plane and said axis is biased in a direction which is radial relative to a portion of the inside curvature of said track means for tensioning same and said idler means includes a circumferencial groove adapted to cooperate with said pins for controlling the relative side to side movement of the upper portion of said track means as same is moved over said idler means.

4. The amusement vehicle of claim 1 wherein said interconnecting means includes a cable and pulley arrangement adapted to be connected to said plunger and said transportation means for movement of said plunger in one direction as part of said transportation means moves in an equal and opposite direction permitting said transportation means to feed a projectile into the breech of said aiming device only when said plunger is in its fully cocked position and said breech is open.

5. The amusement vehicle of claim 4 wherein said projectile transportation means includes a shuttling pawl which is adapted to carry projectiles in one direction only and is permitted to skip over immediately juxtaposed projectiles aligned in end to end relation whereby said projectiles may only be fed toward the breech of said aiming device.

6. The amusement vehicle of claim 1 wherein said torsionally biased rotatable pins include an arm on each connected to said pins where they extend through said walls and said arms carry a knob for supporting one end of a resilient member.

7. The amusement vehicle of claim 6 wherein each said resilient member is disposed between each said knob and an adjustable support carry on the inside of said walls whereby movement of said support is used to control the tension of said resilient member.

8. The amusement vehicle of claim 7 wherein said adjustable support is rotatably mounted relative to said walls and said resilient member is a closed loop flexible membrane whereby tension on said arms can be increased by rotating said support where it is connected to said member away from said arm.

9. The amusement vehicle of claim 1 wherein said force means connected between said plunger and said enclosure includes a flexible membrane for urging said plunger into said aiming device and said plunger includes resilient stop means carried thereon to damp the force expended by said force means.

10. The amusement vehicle of claim 9 wherein said connection between said force means and said plunger is adjustable relative to said plunger for controlling the initial tension of said plunger when same is in said aiming device.

* * * * *